US007437859B2

(12) United States Patent
Stolarov

(10) Patent No.: US 7,437,859 B2
(45) Date of Patent: Oct. 21, 2008

(54) METHOD FOR PRODUCING OBJECTS, VOLUMES, FURNITURE MODULES AND FURNITURE, AND ARTICLES PRODUCED BY SAID METHOD

(76) Inventor: Penio Stolarov, Roentgenstrasse 3, 10587 Berlin (DE)

( * ) Notice: Subject to any disclaimer, the term of this patent is extended or adjusted under 35 U.S.C. 154(b) by 750 days.

(21) Appl. No.: 10/451,973

(22) PCT Filed: Dec. 17, 2001

(86) PCT No.: PCT/DE01/04865

§ 371 (c)(1),
(2), (4) Date: Jun. 30, 2003

(87) PCT Pub. No.: WO02/052985

PCT Pub. Date: Jul. 11, 2002

(65) Prior Publication Data

US 2004/0045249 A1 Mar. 11, 2004

(30) Foreign Application Priority Data

Jan. 5, 2001 (DE) ..... 101 01 120
Dec. 14, 2001 (DE) ..... 101 64 559

(51) Int. Cl.
*E04C 2/00* (2006.01)

(52) U.S. Cl. ..... 52/631; 52/656.9; 52/653.2; 108/156

(58) Field of Classification Search ..... 52/631, 52/656.9, 655.1, 653.2, 656.1, 658, 664; 144/344, 345; 29/897, 897.312, 897.33, 29/469.5; 403/171, 176; 108/156, 155, 190
See application file for complete search history.

(56) References Cited

U.S. PATENT DOCUMENTS 3,212,464 A * 10/1965 Steuer ..... 108/159
3,705,557 A * 12/1972 Budington ..... 108/150
3,717,377 A * 2/1973 Johnson ..... 297/440.12
3,729,244 A * 4/1973 Butler ..... 312/195
3,731,449 A * 5/1973 Kephart, Jr. ..... 52/631
3,755,031 A * 8/1973 Hoffman et al. ..... 156/79
3,881,794 A * 5/1975 Henning ..... 312/259
3,939,615 A * 2/1976 Sorkin ..... 52/81.6

(Continued)

*Primary Examiner*—Richard E. Chilcot, Jr.
*Assistant Examiner*—Chi Q. Nguyen
(74) *Attorney, Agent, or Firm*—Henry M. Feiereisen; Ursula B. Day

(57) ABSTRACT

The invention relates to a method for producing objects, volumes, furniture modules and furniture as well as articles produced by said method that are composed of individual elements such as walls, panels, beams, legs, etc. The aim of the invention is to provide a method and articles produced according to said method that allow to provide objects, volumes, furniture modules and furniture that are highly stable and yet have a low weight, require a minimum of To this end, a) a flat composite material that has a uniform thickness and that is composed of a plurality of layers in the form of an unwound section of the element is cut out;
b) fold lines are applied to said section;
c) the fold lines according to step b) are cut in;
d) the section is folded along the cut lines according to step c);
e) the blank is shaped to a folded thin-walled shell;
f) the folded thin-walled shell is joined to an individual element;
g) the individual elements of step f) are composed to give objects, volumes, furniture modules and furniture.

The articles produced according to this inventive method are characterized by a folded, thin-walled shell of a composite material that has a uniform thickness and that is composed of a plurality of layers.

10 Claims, 10 Drawing Sheets

U.S. PATENT DOCUMENTS 3,943,022 A * 3/1976 Susnjara ..... 156/211
4,034,533 A * 7/1977 Faas ..... 52/591.1
4,402,170 A * 9/1983 Seidner ..... 52/631
4,520,758 A * 6/1985 Pfriender ..... 119/499
4,685,401 A * 8/1987 Sheffer ..... 108/157.14
5,015,033 A * 5/1991 Winters ..... 297/188.12
5,234,727 A * 8/1993 Hoberman ..... 428/12
5,345,737 A * 9/1994 Latchinian ..... 52/280
5,394,810 A * 3/1995 Howard et al. ..... 108/165
5,516,225 A * 5/1996 Kvols ..... 403/170
6,126,239 A * 10/2000 Hazzard ..... 297/440.1
6,619,007 B1 * 9/2003 Riesmeier ..... 52/631
6,678,934 B1 * 1/2004 LaSusa ..... 29/458
6,789,792 B1 * 9/2004 Angland ..... 269/289 R
6,800,351 B1 * 10/2004 Pflug et al. ..... 428/73
7,086,436 B2 * 8/2006 Gottlieb ..... 144/368

* cited by examiner

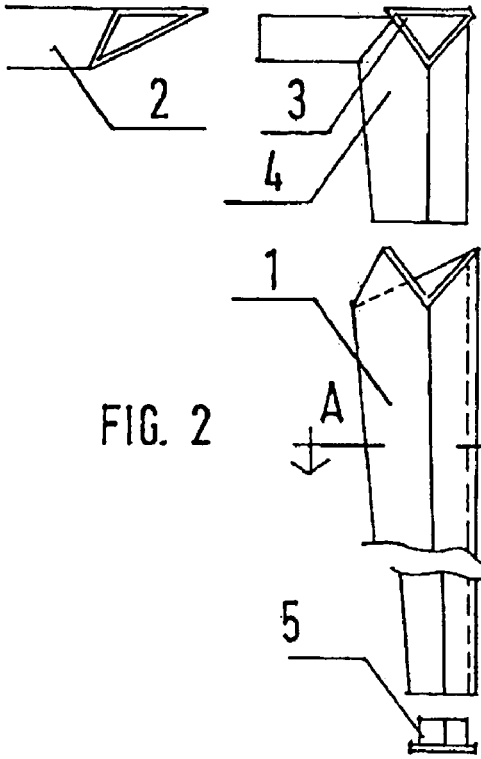
FIG. 2
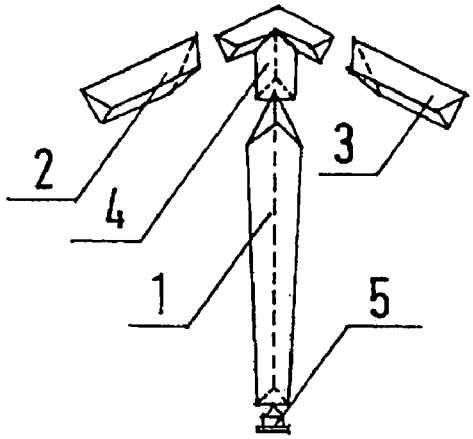
FIG. 1
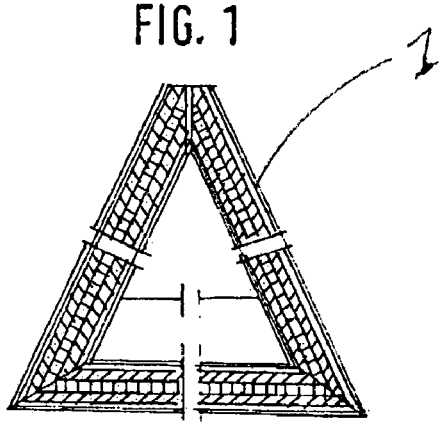
FIG. 3 A-A
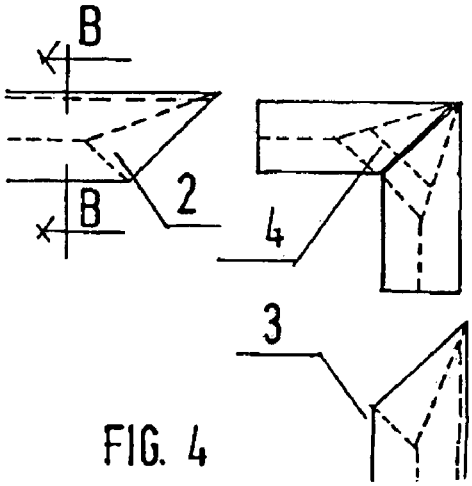
FIG. 4
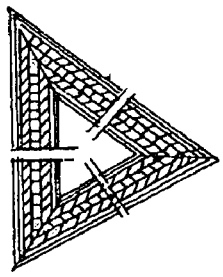
FIG.5 B-B

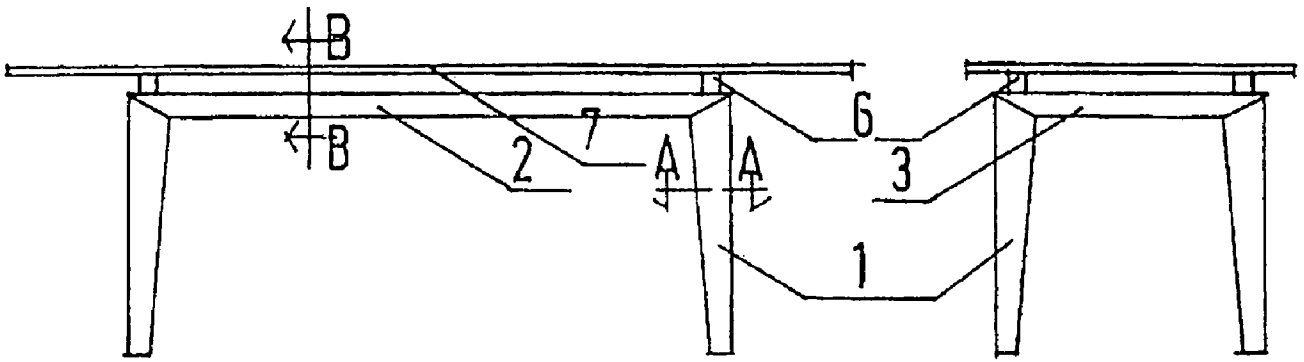
FIG. 7
FIG. 8
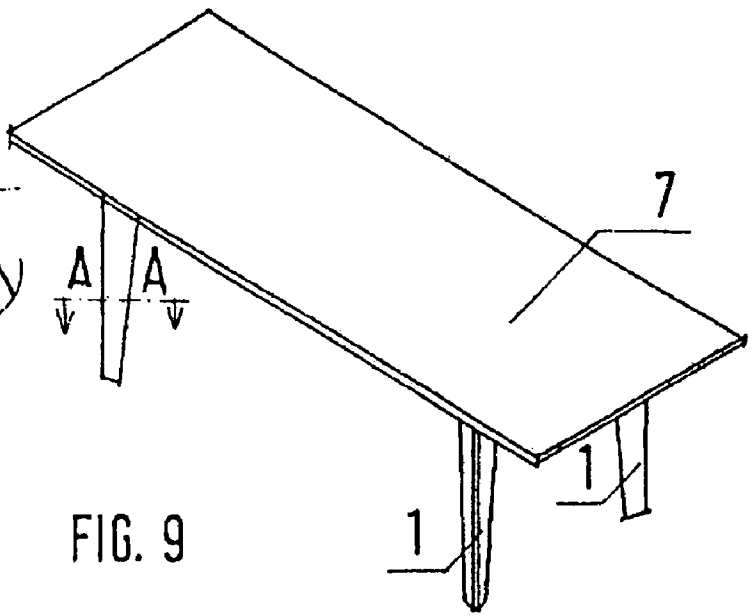
FIG. 9
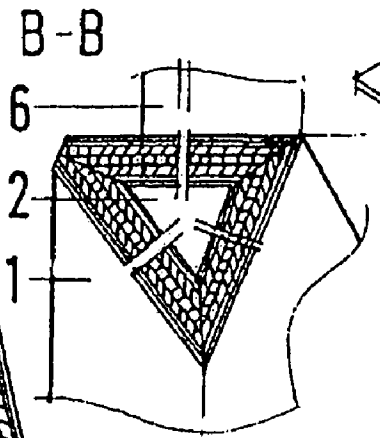
FIG. 7b
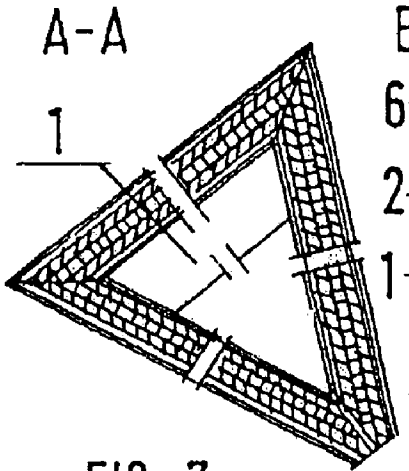
FIG. 7a

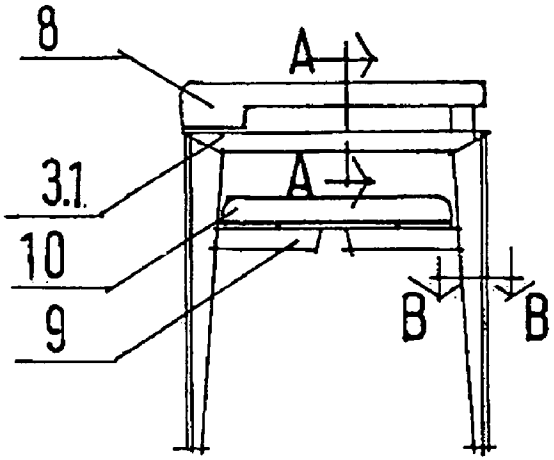
FIG. 11
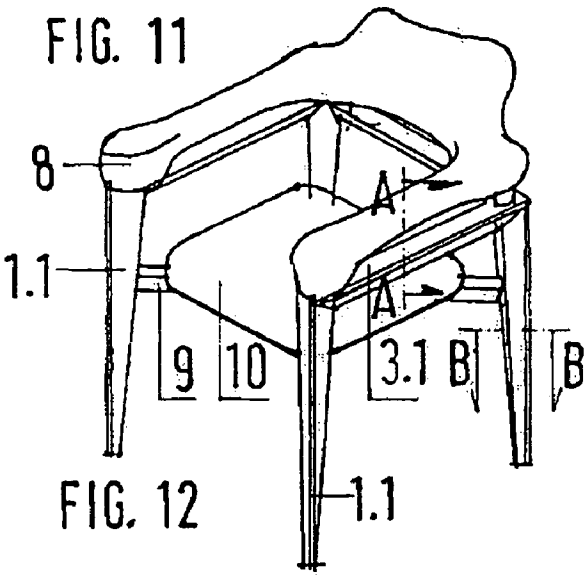
FIG. 12
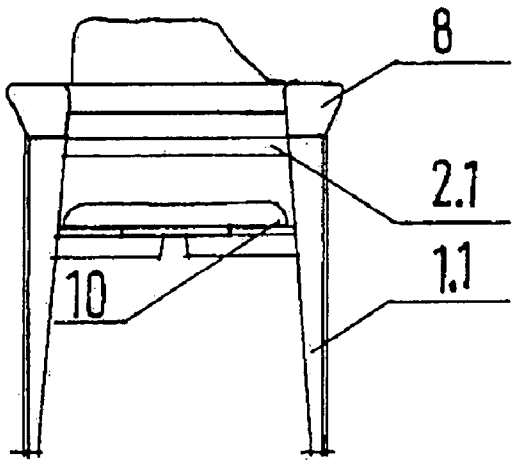
FIG. 10
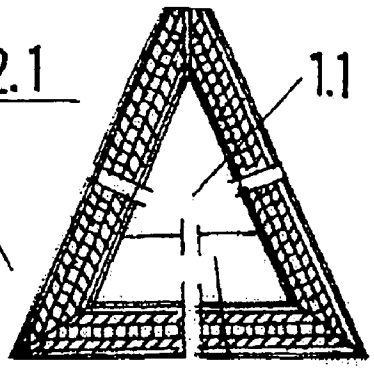
FIG. 11b B-B
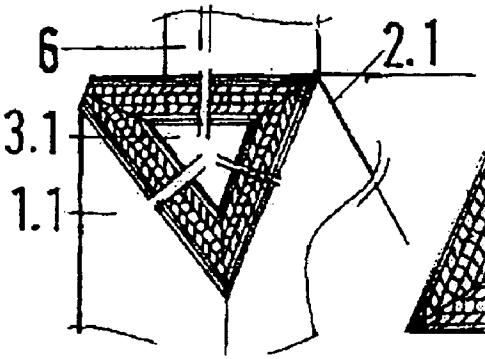
FIG. 11a A-A FIG. 13a A–A
12
15
2.2
11
B
12
32

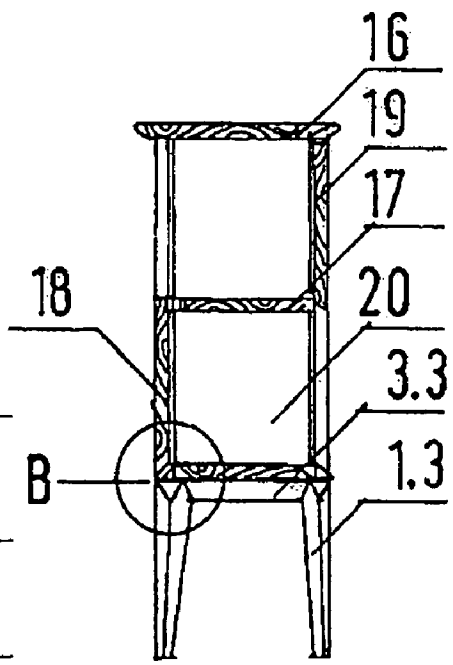
FIG. 16a A-A
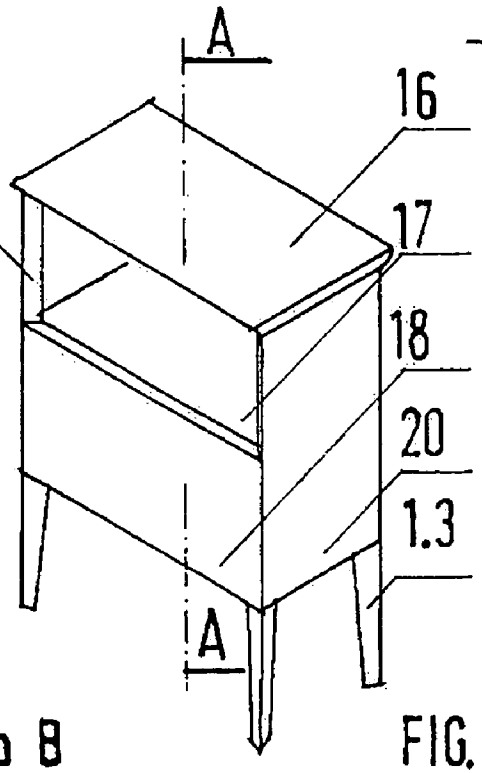
FIG. 17
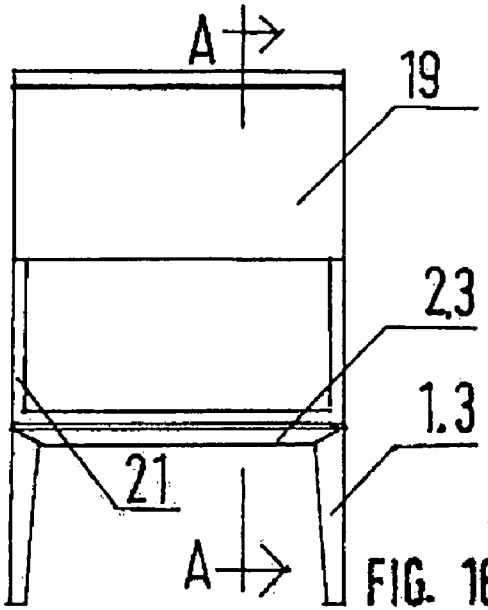
FIG. 16
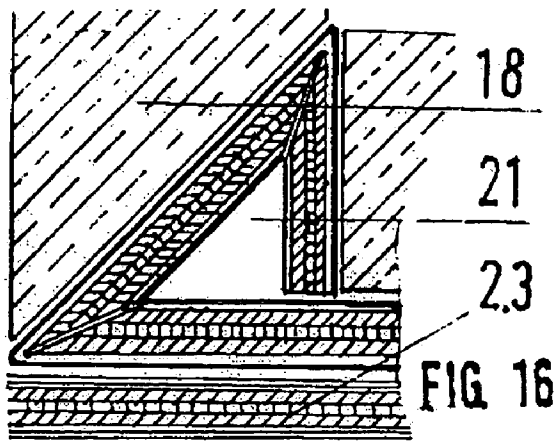
FIG. 16b B FIG. 19
The investment to implement the technology is negligible
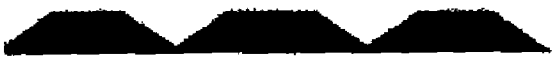
- You have the cutting machines
- You may need a new cutting head
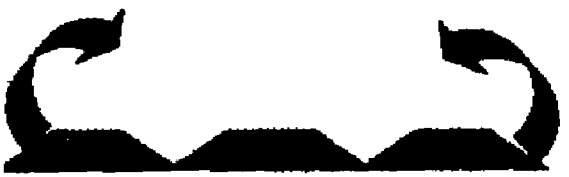
- You will need a glueing/folding robot
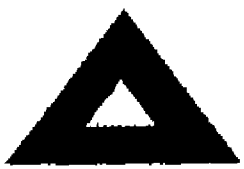
- You can assemble

An obvious consequence is that any surface can be paired with any sandwitch to satisfy any esthetic and structural needs.

**4*4=16, but in reality the possibilities are endless**

METHOD FOR PRODUCING OBJECTS, VOLUMES, FURNITURE MODULES AND FURNITURE, AND ARTICLES PRODUCED BY SAID METHOD

BACKGROUND OF THE INVENTION

The invention relates to a method for producing objects, volumes, furniture modules and furniture that are composed of individual elements, such as walls, panels, struts, support beams, legs, or the like.

The invention also relates to objects for interior and exterior design, such as objects, volumes and furniture modules, especially office furniture, consisting of individual elements.

There are well-known methods for the manufacture of furniture and furniture elements whose initial basis is a flat material. These methods use single-layered material whose plastic and elastic qualities are the same throughout the cross-section of the material. This single-layered material is then cut and folded, so that the individual parts, such as table plates, table legs or table beams, form furniture modules.

For example, GB 1 196 445 describes a table construction built from a flat material using the method described above. But this construction requires the insertion of a common wall between the furniture elements in order to achieve the requisite stability for the construction.

GB 1 205 275 describes a method for furniture manufacture using cardboard or another plastic material which is combined to form closed modules. In these well-known furniture modules, the requisite stability is achieved through a common wall between two furniture elements standing next to each other.

Other known furniture designs are described in EP 0 221 342 A1 and DE 3 906 936 A1, which also do not have sufficient rigidity and stability.

With this prior art, the aim of the invention is to provide a method and articled produced according to said method that allow to provide objects, volumes, furniture modules and furniture that are highly stable and yet have a low weight, require a minimum of material and have a characteristic design.

SUMMARY OF THE INVENTION

This aim is realized through the method of the present invention producing objects, volumes, furniture modules and furniture composed of individual structural elements and comprising the steps of: providing a flat composite material of uniform thickness having a plurality of layers, cutting from the flat material a blank for the structural element, applying desired fold lines to the blank, cutting into the fold lines, folding the blank along the cut-in fold lines, thereby realizing outer edges, joining outer edges of the blank to form a folded thin-walled shell of a structural element, and connecting two or more structural elements via a fixing nodal element and by an article for interior and exterior design, which is an object, volume, furniture modules, wherein the individual structural element are a folded, thin-walled shell of uniform thickness.

Advantageous embodiments of the method and the objects can be found in the sub-claims.

Each individual element is cut from a flat material which has uniform thickness and has a plurality of layers. The layers of the material are selected so that the outer layers and the inner layer have different plastic qualities, stability and malleability. While the individual elements are being cut out, the multi-layered flat material is slit along the fold lines, creating inner and outer edges to fold the unwound section, forming a folded, thin-walled shell for the furniture element after the outer edges are stuck together. The furniture elements produced in this manner are connected by a fixing element, so that the individual elements, which are cut at a specific angle, can be mounted and stuck to the three solid sections of the fixing element and the outer edges meet at a single point.

A furniture element results which is shaped as a folded, thin-walled shell and is composed of one leg and two support beams. The fixing element is composed of three solid sections, which are positioned at a 90° angle to one another and have a common peak, so that each of the solid sections has a cross-section which corresponds with the outlines of the element it connects, which is shaped to a folded, thin-walled shell.

The furniture module, which is formed as a folded, thin-walled shell, and the furniture manufactured using this method are comprised of a multi-layered flat material, such as aluminium outer layers, with a middle layer of a hard material, such as plywood. The individual furniture elements can have a triangular, rectangular or polygonal cross-section.

This method enables the manufacture of tables, chairs and cabinets, with or without doors, which can be used from either side. The table consists of a furniture module, shaped to a folded, thin-walled shell (table frame with legs), with a table plate on top, supported by elements placed in the four corners of the table frame, creating a distance between the table plate and the supporting table frame.

The chair consists of a furniture module formed as a folded, thin-walled shell, on which an arm- and backrest is placed, which lies on two elements fastened in the rear corners of the module, creating a distance between it and the supporting module. Four x-shaped consoles formed as a folded, thin-walled shell are mounted on the legs of the chair at ⅔ ground level, which serve as supports for the seat.

The cabinet without doors consists of elements formed as folded, thin-walled shells and combined into a supporting furniture module, so that two u-shaped furniture elements rest on this furniture module which are also manufactured using this method and are joined together on the inner vertical walls, e.g. with glue. The outer edges of the two u-shaped elements are also formed as folded, thin-walled shells and a plate is mounted on the open end facing upwards. The back side of the cabinet is closed. The space between the plate, the rear element and the horizontal wall is divided into four sections by vertical elements.

The cabinet, which is accessible from both sides, is composed of individual elements manufactured as folded, thin-walled shells according to the said method. A u-shaped element is fastened onto the supporting furniture module, so that a plate can be positioned on the vertical walls. The space between the plate and the horizontal wall can be closed by two elements moving vertically. When one element is up, the other is down. Thus, the opposite sides of the cabinet are closed above and below.

Objects, volumes, furniture modules and furniture manufactured according to the said method are characterized, above all, by their lightness and stability, since the supporting structure is a closed, folded, thin-walled shell and the individual elements are stuck together with a solid connection. The sparing use of materials, the simple production method, the potential for altering the thickness of the individual layers of the composite material depending on the necessary spread and the customisation of the flat composite material as required are of particular advantage. In addition, the folded, thin-walled shell is characterized by its characteristic design, making objects volumes, furniture modules or furniture manufactured according to the said method unmistakable.

Another substantial advantage of this method is that by combining multiple materials with differing characteristics, qualities arise in the objects, volumes, furniture elements and furniture which are far superior to the qualities of the individual materials.

For example, the outer layers can be made of metal, plastic, paper, textiles, fibre or leather, depending on interior or exterior design requirements, while remaining within the framework of the invention.

Further advantages and details can be found in the description below, referring to the attached drawings.

BRIEF DESCRIPTION OF THE DRAWINGS

The invention will now be explained in greater detail using the four execution examples below.

These illustrate:

FIG. 1 An axonometric representation of a nodal point on the corner of a table manufactured using this method;

FIG. 2 View of a fixing element with cross-section through a beam and view of a leg, a beam, and a foot;

FIG. 3 Cross-section along Line A-A as in FIG. 2;

FIG. 4 Top view of the nodal point depicted in FIG. 1;

FIG. 5 Cross-section along Line B-B as in FIG. 4;

FIG. 7 Frontal view of a table produced using this method;

FIG. 7*a* Cross-section along Line A-A as in FIG. 7;

FIG. 7*b* Cross-section along Line B-B as in FIG. 7;

FIG. 8 Side view of a table produced using this method as in FIG. 7;

FIG. 9 Axonometric representation of a table as in FIG. 7;

FIG. 10 Frontal view of a chair produced using this method;

FIG. 11 Side view of chair as in FIG. 10;

FIG. 11*a* Cross-section along Line A-A as in FIG. 11;

FIG. 11*b* Cross-section along Line B-B as in FIG. 11;

FIG. 12 Axonometric representation of a chair as in FIG. 10;

FIG. 13*a* Cross-section along Line A-A as in FIG. 13;

FIG. 13*b* Enlarged representation of Detail B in FIG. 13*a;*

FIG. 16 Frontal view of a cabinet produced using this method with dual-side use;

FIG. 16*a* Cross-section along Line A-A as in FIG. 16;

FIG. 16*b* Enlarged representation of Detail B of FIG. 16*a;*

FIG. 17 Axonometric representation of the cabinet with dual-side use and

FIG. 19 is a cross section of the flat material showing cuts;

DETAILED DESCRIPTION OF THE DRAWINGS

Figure 6:
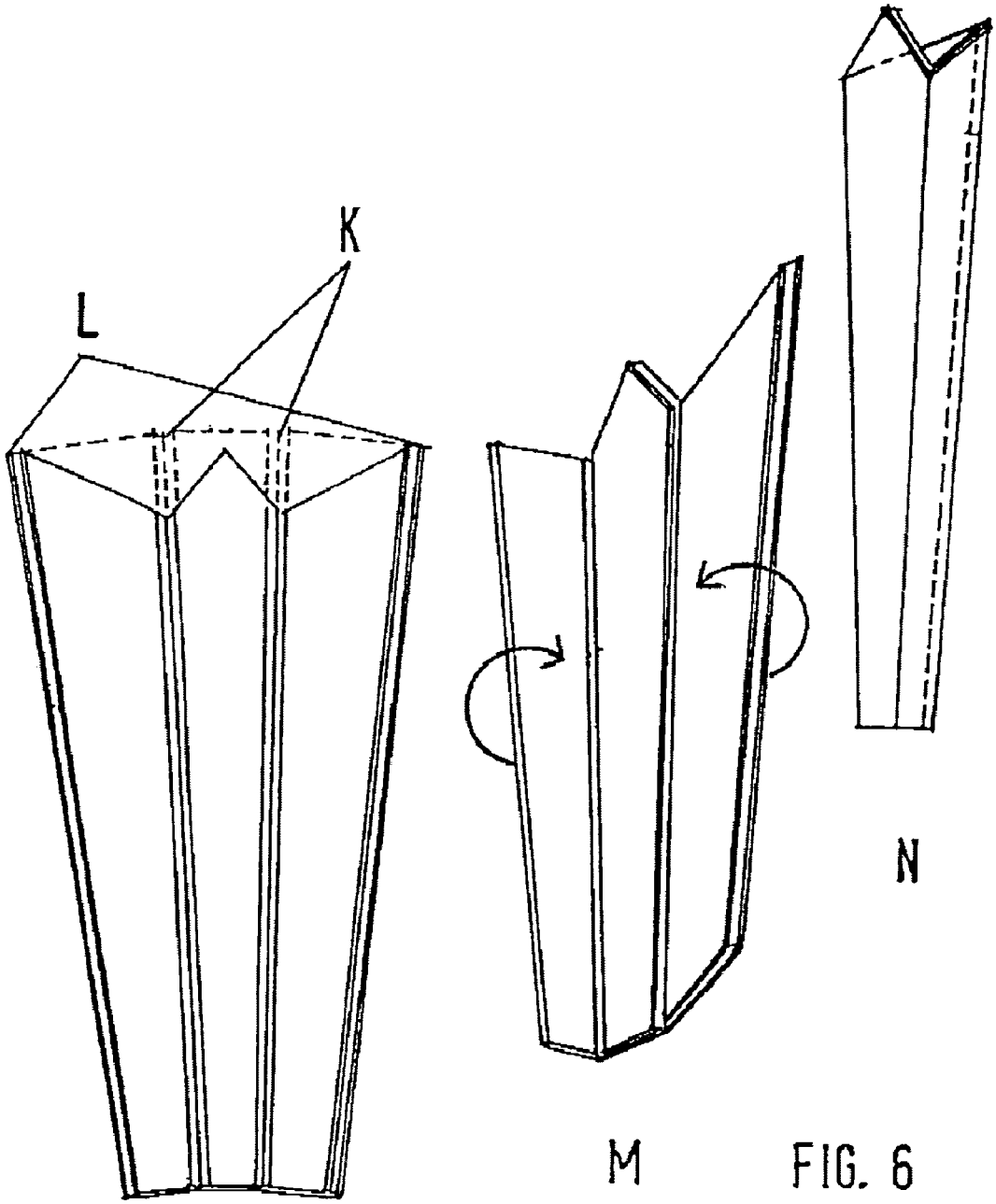
FIG. 6 Development of a table leg, with representation of fold lines and outer edges.

In FIGS. 1 through 6, the method is explained in greater detail on the example of the manufacture of a furniture module. The basic element in the furniture module, which was selected by way of example, is a folded, thin-walled shell which is combined into nodal points.

FIG. 1 depicts the composition of such a nodal point from a table leg (1), a beam assigned to the long side of the table (2) and a beam assigned to the short side of the table (3), which are connected by a solid fixing nodal element (4).

In FIGS. 1, 2 and 4 the cross-section of beams 2 and 3 is recognisable. The cross-section surfaces are at a specified angle to each other. The cross-sections have triangular outlines. The solid fixing nodal element (4), with its branches positioned in axes x, y and z, attached at a 90° angle, and having a common peak, is introduced into the beams (2 and 3) and table leg 1, which are shaped to folded, thin-walled shells. The elements are cut out in such a manner that the outer edges can be combined into a single point at the peak of the solid section. All sections of the nodal point are then stuck together. Preferably, a polyurethane glue is used as an adhesive. The table leg (1) ends with a foot (5).

In FIGS. 3 and 5, the characteristic design is recognisable in the form of the triangular profile of table leg 1 and beams 2 and 3. Table leg 1 is an equilateral triangle changing with the height and all three sides of beams 2 and 3 have equal length. These elements are connected. The edge at the peak of the equilateral triangle of table leg 1 is positioned vertically. The edges at the base of the triangle are positioned at a certain angle to the vertical elements.

FIG. 6 shows the development of table leg 1 with fold lines (K) and outer edges (L), as well as the outline of the element, the folding process (M), and a view of a folded leg element (N).

Under this method, each furniture element is produced in a specific sequence of processes: the multi-layered e.g. three-layered flat material of uniform thickness is cut out based on a specific model, while the material is slit in order to define the trim limes (outer edges) (L) and the fold lines (K), the flat material is folded along the slits, creating inner and outer edges, and the outer edges (L) are stuck together, forming a closed, folded, thin-walled shell which is to be used as a furniture element. The furniture elements produced in this manner are then attached to elements produced in the same manner. The furniture elements produced according to the said method can have different profiles depending on their use, e.g. the horizontal elements have the same cross section as the equilateral triangle throughout their lengths, while the cross section of the vertical elements (the table legs) changes depending on their height. The horizontal elements are used as support beams and the vertical elements as furniture legs.

Under the invention, the profile can also be any other polygonal shape. The individual furniture elements are connected by a fixing element. The sections, which are cut at a specified angle, are connected by mounting the three elements, which are formed as folded, thin-walled shells, on the three solid sections of the fixing element so that the outer edges meet at a single point and all sections are stuck together. In this sequence, the furniture elements, which are shaped to folded, thin-walled shells, are created and combined with a fixing element, e.g. two horizontal beams and a vertical leg, to form a furniture module.

EXAMPLE 1

FIGS. 7 through 9 depict a table manufactured according to the said method. The four table legs (1) and the four table beams (2 and 3) are shaped to a folded, thin-walled shell and connected by the solid fixing nodal element (4). The table plate (7) is positioned on four buffers 6, i.e. each positioned in a corner of the table, which guarantees a distance between the table plate (7) and the table beams (2 and 3).

The table produced according to the said method can serve as a conference table, a work table or a side table, depending on the need.

EXAMPLE 2

FIGS. 10 through 12 depict a chair manufactured according to the said method. The four legs (1.1), a beam (2.1), and two beams (3.1) on both sides, which are connected by the fixing nodal elements (4), which are composed of a folded, thin-walled shell. The support structure of the chair has four nodal points. Solid fixing elements (4) are used in each nodal point.

The back- and armrest section (8) is fastened to the rear by two buffers. On the four legs (1), at a distance of about ⅔ from the bottom of the legs, an x-shaped construction is mounted consisting of four thin-walled, folded consoles (9), on which the seat (10) is fastened.

EXAMPLE 3

Figures 13, 14:
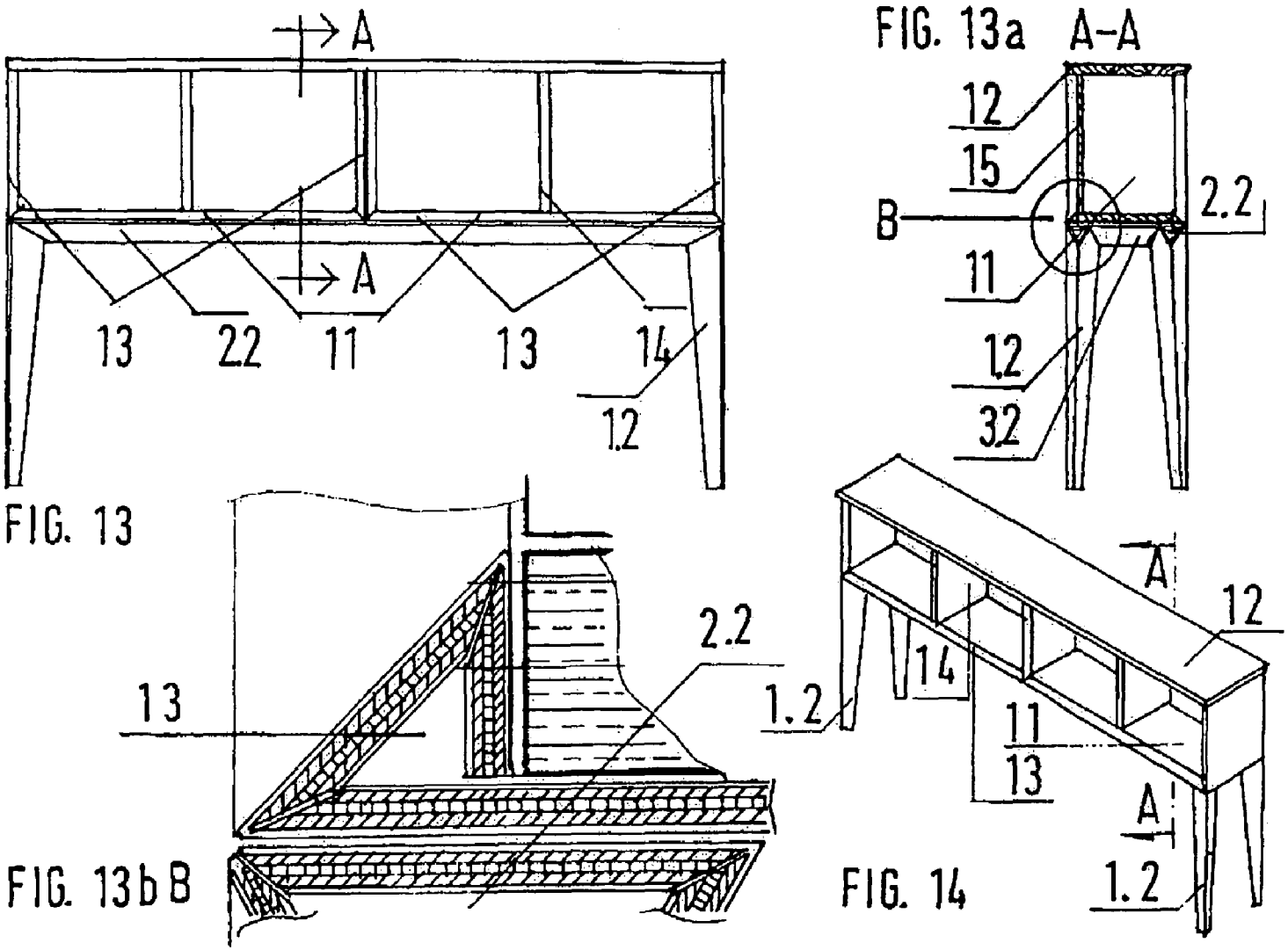
FIG. 13 Frontal view of a cabinet without doors produced using this method.
FIG. 14 Axonometric representation of a cabinet without doors as in FIG. 13.
Figure 15:
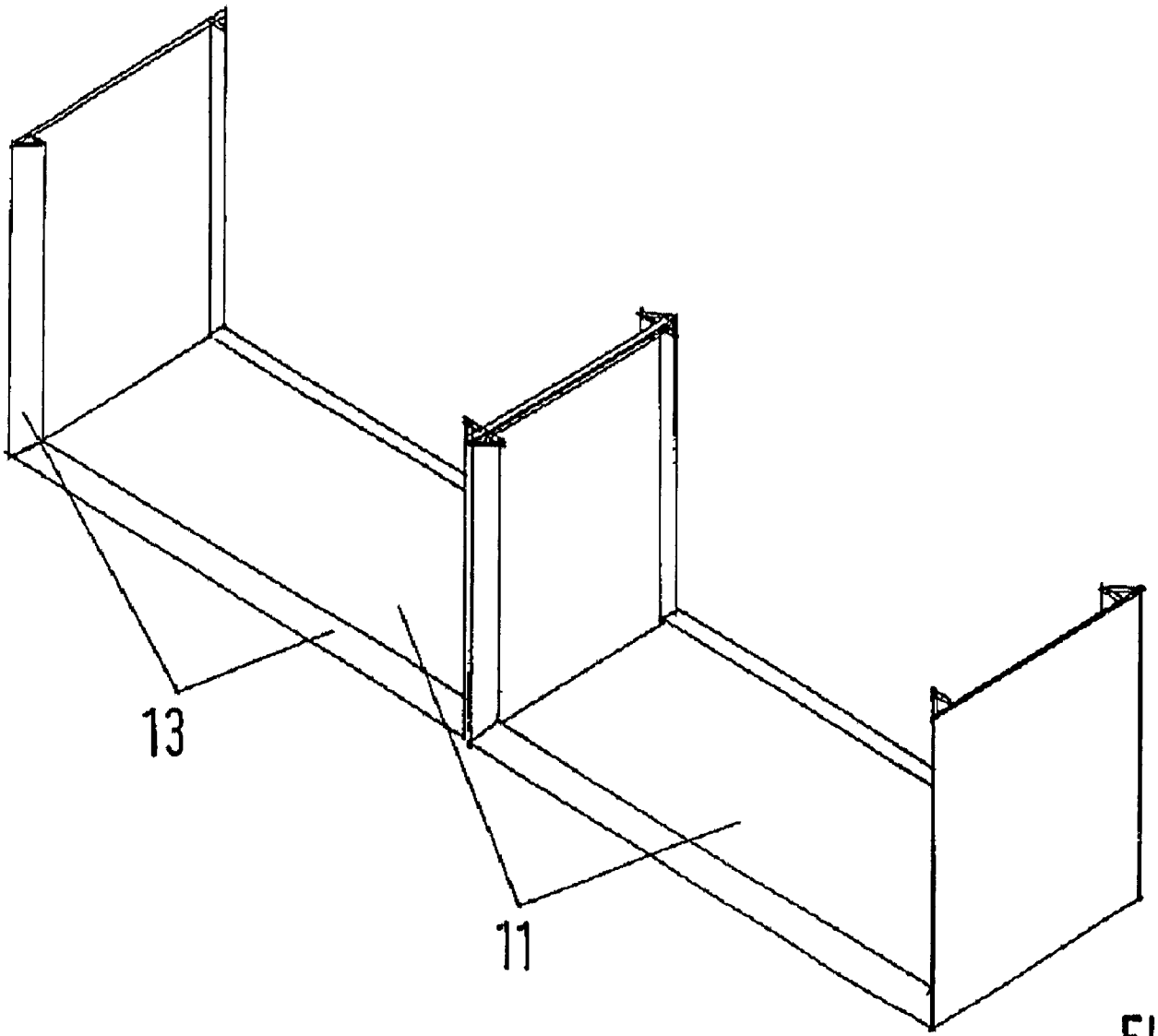
FIG. 15 Axonometric representation of a furniture element as depicted in FIG. 13.

FIGS. 13 through 15 depict a cabinet without doors which is produced using the said method. The cabinet has four legs (1.2) and a frame consisting of two beams (2.2) and two beams (3.2). The legs and beams are shaped to folded, thin-walled shells, serving as a support construction. Two u-shaped furniture elements (11) are mounted on this construction. They have edges (13), which are also shaped to folded, thin-walled shells. A common plate (12) is positioned on the two u-shaped elements (11) which are stuck together. The rear of the cabinet has a back element (15). The space between the plate (12), the back element (15) and the horizontal wall is divided into four sections by vertical elements (14). The furniture element (11) has edges which are formed accordingly (13).

EXAMPLE 4

Figure 18:
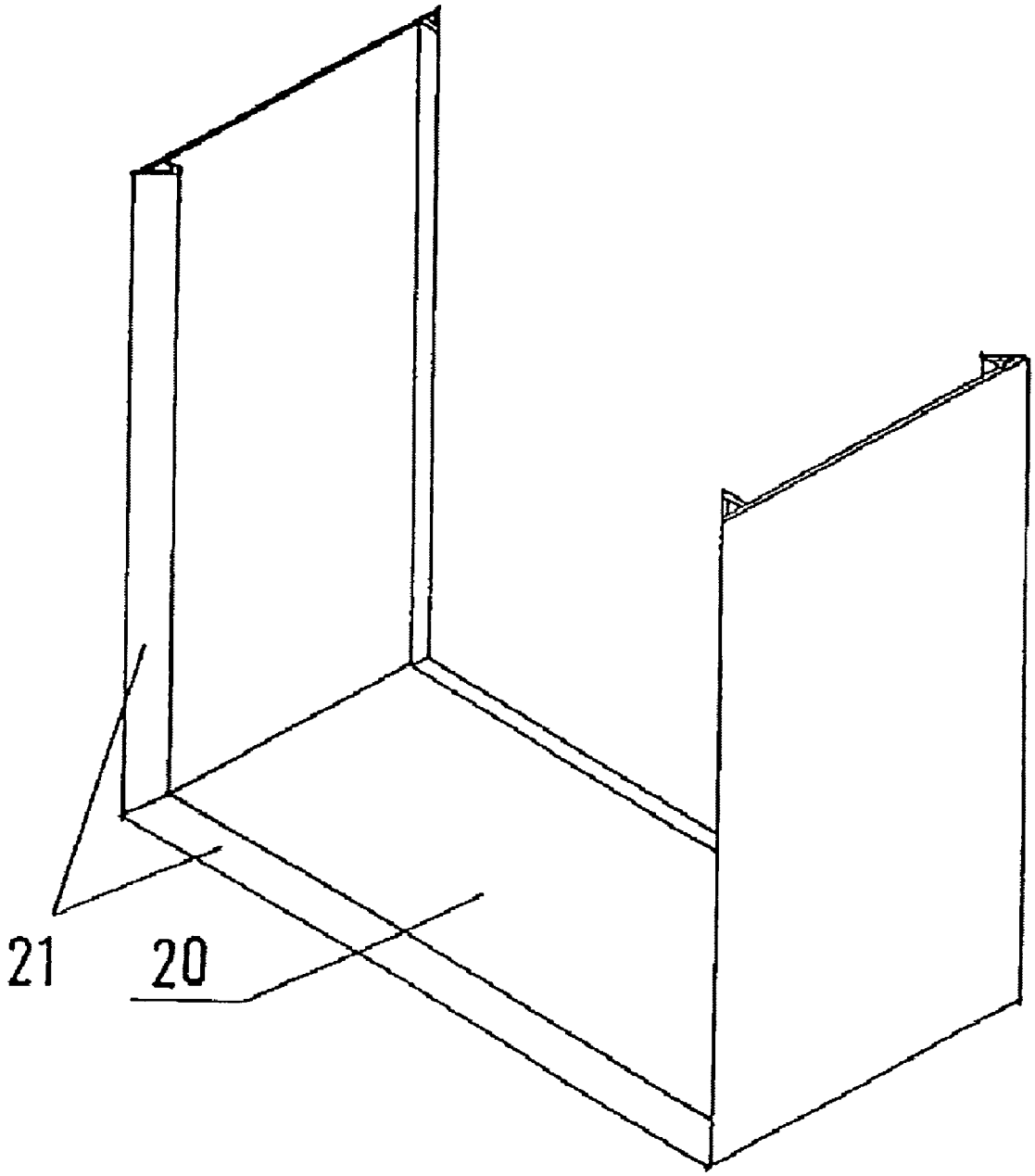
FIG. 18 Axonometric representation of a furniture element of the cabinet depicted in FIG. 16.

FIGS. 16 through 18 depict a cabinet accessible from both sides which produced according to the said method. A u-shaped element (20) is mounted on the support structure consisting of four legs (1.3) and a frame consisting of two beams (2.3) and two beams (3.3). On this element, (20) a plate (16) is positioned. The space between the plate (16) and the horizontal wall of element 20 is divided into two sections by a horizontally-positioned element (17). The vertical sliding doors (18 and 19) are connected by a rope structure (not shown). By moving the sliding door (18) upwards, the other sliding door (19) moves downwards. The furniture element (20) also has the characteristic edges, which are formed as folded, thin-walled shells (21).

Figure 20:
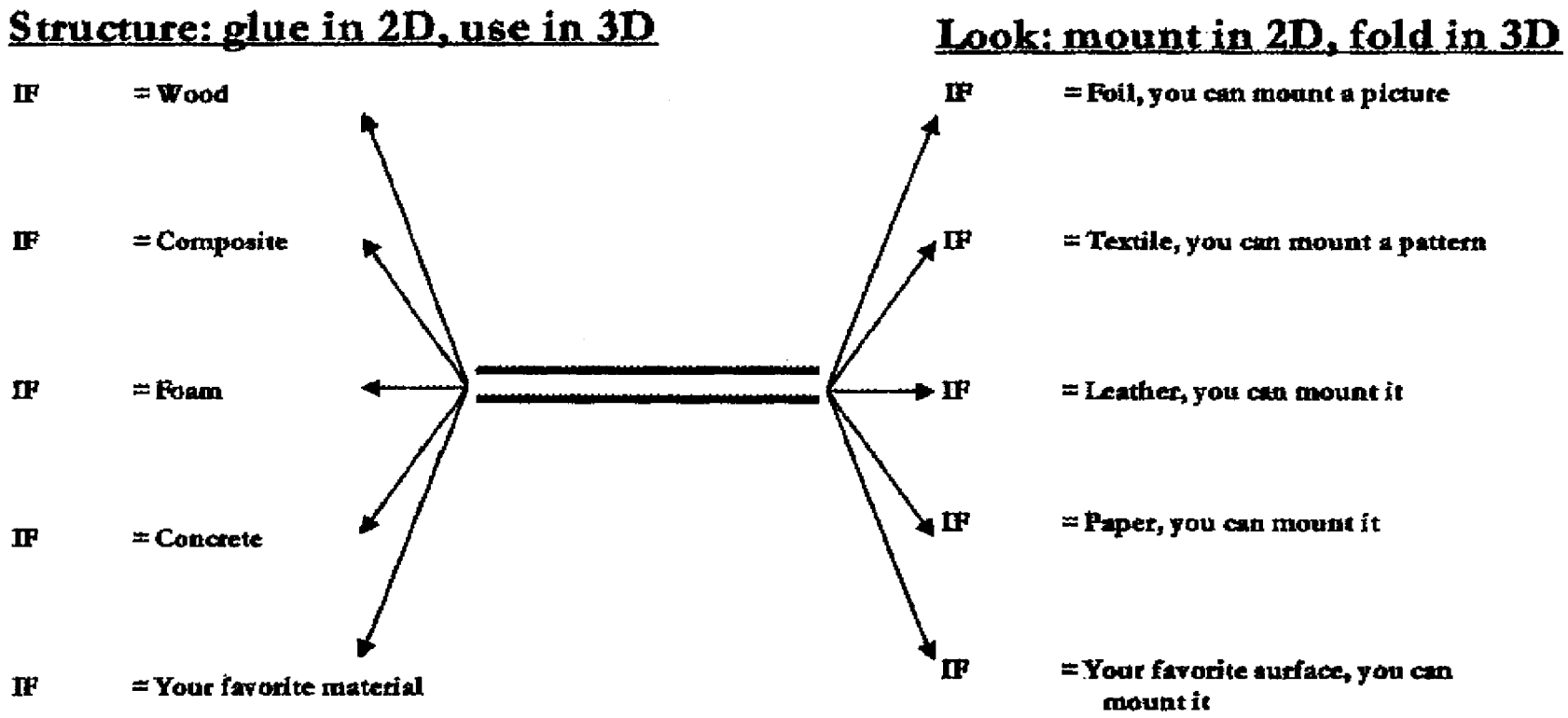
FIG. 20 is a flow chart for producing hollow structures from various materials.

FIG. 19 shows the flat material after it has been cut and before the folds are made to produce a hollow structural element. FIG. 20 is a flow chart in which the materials and the possibilities for use of materials are shown.

| List of reference numbers used | |
|---|---|
| Table leg | 1 |
| Chair leg | 1.1 |
| Leg of the cabinet without doors | 1.2 |
| Leg of the cabinet with dual-side use | 1.3 |
| Table beams | 2 |
| Chair beams | 2.1 |
| Beams of the cabinet without doors | 2.2 |
| Beams of the cabinet with dual-side use | 2.3 |

-continued

| List of reference numbers used | |
|---|---|
| Table beam | 3 |
| Chair beam | 3.1 |
| Beams of the cabinet without doors | 3.2 |
| Beams of the cabinet with dual-side use | 3.3 |
| Fixing nodal element | 4 |
| Foot | 5 |
| Buffers | 6 |
| Table plate | 7 |
| Back- and armrest element | 8 |
| Console | 9 |
| Seat | 10 |
| U-shaped furniture elements of the cabinet without doors | 11 |
| Plate of the cabinet without doors | 12 |
| Edges of the u-shaped furniture element of the cabinet without doors | 13 |
| Vertical elements of the cabinet without | 14 |
| Back element of the cabinet without doors | 15 |
| Plate of the cabinet with dual-side use | 16 |
| Horizontally-positioned element of the cabinet with dual-side use | 17 |
| Vertical sliding door | 18 |
| Vertical sliding door | 19 |
| U-shaped cabinet element with dual-side use | 20 |
| Edges of u-shaped element with dual-side use | 21 |
| Fold lines | K |
| Outer edges | L |
| Folding process | M |
| Folded leg element | N |

The invention claimed is:

1. A method for producing objects, volumic elements, modules and furniture made from modules composed of individual structural elements comprising the steps of:

providing a flat composite material of uniform thickness having a plurality of layers, cutting from the flat material a blank for the structural element, applying desired fold lines to the blank including angular end portions for forming an angled connecting site, cutting into the fold lines, folding the blank along the cut-in fold lines, thereby realizing outer edges, joining outer edges of the blank to form a closed folded thin-walled shell of a structural element having weight bearing capacity, and connecting two or more structural elements via a fixing nodal element, at the angled connecting site for joining two or more structural elements via the fixing nodal element, whereby the angled sites of each of the elements are meeting at a single point to form a corner, and wherein the nodal element has legs angularly oriented for inserting into the corresponding shell of the structural element such that the angled sites of each element are joined to form a single point and the inserted fixing nodal element is thus no longer visible.

2. The method of claim 1, further comprising the step of joining the fixing nodal element at a 90 degree angle to each of the structural elements to form a connection wherein the fixing nodal element has a cross-section fitting into a cross section of the structural element to be connected to a single point.

3. The method of claim 1, wherein the composite material is composed of plastic malleable outer layers and a middle layer made of a hard, non-malleable material.

4. The method of claim 3, wherein the malleable material of the outer layers are selected from the group consisting a material; which is a metal-, plastic-, paper-, textile-, fiber- or leather-based material.

5. The method of claims 4, wherein the metal is aluminum.

6. The method of claim 3, wherein the non-malleable material utilized for the middle layer is selected from the group consisting of plywood, foam, glass, stone, cement or ceramic.

7. The method of claim 1, wherein the outer ends of the folded, blank are joined by gluing, reshaping, retro-shaping, pressing, force-fitting, soldering, welding or textile joining.

8. The method of claim 7, wherein the joining of the outer ends is carried out gluing with a chemically reactive adhesive.

9. The method of claim 8, wherein the adhesive is polyurethane.

10. The method of claim 1, wherein the folded, thin-walled shell of the structural element is constructed with a polygonal, triangular or rectangular, cross-section.

* * * * *